United States Patent [19]

Raviv et al.

[11] 4,386,499

[45] Jun. 7, 1983

[54] AUTOMATIC START-UP SYSTEM FOR A CLOSED RANKINE CYCLE POWER PLANT

[75] Inventors: Avi Raviv, Rehovot; Abraham Dahan, Holon, both of Israel

[73] Assignee: Ormat Turbines, Ltd., Yavne, Israel

[21] Appl. No.: 209,533

[22] Filed: Nov. 24, 1980

[51] Int. Cl.³ ..... F01D 25/22

[52] U.S. Cl. ..... 60/657; 60/656

[58] Field of Search ..... 60/646, 656, 657; 184/6, 6.3

[56] References Cited

U.S. PATENT DOCUMENTS

| | | | |
|---|---|---|---|
| 2,961,550 | 11/1960 | Dittman | 184/6 X |
| 3,393,515 | 7/1968 | Tabor et al. | 60/657 |
| 3,447,314 | 6/1969 | Majkvzak | 60/657 |

*Primary Examiner*—Allen M. Ostrager
*Assistant Examiner*—Stephen F. Husar
*Attorney, Agent, or Firm*—Sandler & Greenblum

[57] ABSTRACT

Vaporized working fluid is supplied only to the condenser of a power plant of the type described when the power plant is cold started allowing condensate to lubricate the bearings of the prime mover before the latter begins to move. When the power plant is in steady-state operation, vaporized working fluid is supplied only to the prime mover.

21 Claims, 5 Drawing Figures

OUTPUT VOLTAGE
FUEL
CONTROL

AUTOMATIC START-UP SYSTEM FOR A CLOSED RANKINE CYCLE POWER PLANT

DESCRIPTION

Technical Field

This invention relates an automatic start-up system for a closed, Rankine cycle power plant which used an organic working fluid that also lubricates the bearings of the prime mover of the power plant, such power plant being termed hereinafter "a power plant of the type described".

Background Art

A power plant of the type described is disclosed in U.S. Pat. No. 3,393,515. Liquid working fluid in the boiler of such power plant is vaporized in response to heating the boiler, and furnished, via a supply conduit, to a prime mover such as a turbine which produces work. Exhaust vapor from the prime mover flows, via an exhaust conduit, into a condenser where condensation takes place. A condensate conduit system connected to the condenser diverts a portion of the condensate to the bearings of the prime mover and then to the inlet of a condensate pump driven by the prime mover while the balance of the condensate is piped directly to the pump which returns the condensate to the boiler.

The reliability of a power plant of the type described is dependent, essentially, on the bearing life inasmuch as the only moving part in the system is the turbine rotor. By utilizing a form of hydrostatic bearings in which the working fluid of the power plant is the lubricant, and by hermetically sealing the prime mover, including the bearings, in a cannister which is maintained at substantially the condenser pressure, the bearing life will be indeterminantly long and the requisite reliability will be achieved. As a consequence, a power plant of the type described is well adapted for, and is currently being successfully utilized as, an electric power generator for unmanned microwave relay stations located in remote regions of the world, wherein the only maintenance required is replenishment of the fuel for the boiler.

In cold-starting a power plant of the type described, a procedure must be followed that will result supplying liquid working fluid to the bearings before the turbine begins to rotate. In the quiescent state of the power plant, the boiler is cold, and all of the working fluid is in a liquid state within the boiler. The bearings are dry with the result that rotation of the turbine for even a short period of time will damage the bearings and result in shutting down the power plant for maintenance. In the patent referred to above, incipient rotation of the turbine is a function of the boiler pressure. That is to say, by slowly heating the boiler and keeping the pressure therein below the operating level at which incipient rotation of the turbine takes place, vaporized working fluid will flow through the turbine and exit into the condenser without rotating the turbine wheel. In the condenser, the vaporized working fluid will condense and a portion will flow into the bearings before turbine rotation commences. Once a steady supply of condensate is supplied to the bearings, the rate of heat applied to the boiler can be increased thereby increasing the boiler pressure to its rated value and causing turbine rotation to begin.

Such a start-up procedure works adequately as long as a prescribed cold-start procedure is followed by personnel charged with starting up the system. However, as is often the case, the prescribed start-up procedure can be bypassed, and in such case, the boiler pressure may too quickly reach rated value allowing the turbine to begin to rotate before the bearings are adequately lubricated. One technique for precluding this situation is to have an automatic, programmed start-up procedure which, once initiated, will automatically sequentially proceed through each step at a predetermined rate. This is an adequate solution to the problem, but the required control system is complicated as well as costly and defeats the simplicity of the basic system. Furthermore, if a manual bypass is available, the capacity for quickly firing the boiler to its rated pressure is still present with the attendent risk in damaging the power plant.

A more reliable and less complex solution to cold-starting a power plant of the type described, in order to insure adequate bearing lubrication s before turbine rotation begins, is disclosed in U.S. Pat. No. 2,961,550 wherein a mercury vapor Rankine cycle power plant is disclosed. In this power plant, vapor from the boiler is supplied directly to the condenser as well as to the turbine through separate pressure responsive valves. The valve connecting the condenser to the boiler operates at a lower pressure than the valve connecting the turbine to the boiler with the result that the initial vapor produced by the boiler when it is cold-started will flow directly to the condenser where it will condense and flow to the bearings of the prime mover. Initially, the boiler pressure is too low to actuate the valve that connects the boiler to the turbine with the result that, if the rate at which heat is furnished to the boiler is low enough, adequate lubrication of the bearings will be acheived while the turbine is stationary.

As soon as the boiler pressure reaches its operating level, the pressure operated valve connecting the boiler to the turbine opens thereby supplying vaporized working fluid to the turbine which begins to rotate. In this manner, the bearings will always be lubricated before the turbine begins to rotate. For this system to work properly, however, the rate at which heat is applied to the boiler must be less than a predetermined value to prevent rapid build-up of pressure in the boiler to a point where the turbine receives vapors before an adequate amount of condensation reaches the bearings. In addition, the simplicity of the system and its reliability are based on continuously furnishing a portion of the vapor produced by the boiler directly to the condenser. This means that a portion of the heat added to the boiler is utilized only for producing condensate that lubricates the bearings, and does not contribute to the work output of the system. Where efficiency of the power plant is critical, the arrangement shown in the last mentioned patent is not satisfactory.

It is therefore an object of the present invention to provide a new and improved automatic start-up system for a power plant of the type described which is more positive than the prior art devices in effectively lubricating the bearings before turbine rotation can start.

DISCLOSURE OF INVENTION

In accordance with the present invention, vaporized working fluid is supplied only to the condenser of a power plant of the type described when the power plant is cold-started, and only to the prime mover when the power plant is in steady-state operation. Specifically, the supply of vaporized working fluid from the boiler to the condenser and to the prime mover depends upon the level of liquid in the boiler. When a power plant according to the present invention is cold-started, all of the working fluid will be in the boiler which will be filled to the cold level. After a predetermined amount of heat is applied to the boiler, the level of liquid therein will drop from the cold level to a predetermined intermediate level located between the cold level and an operating level at which the power plant operates in a steady-state condition. While the liquid in the boiler is between the cold level and the predetermined intermediate level, vaporized working fluid is supplied only to the condenser with the result that the turbine cannot rotate. In this initial transient stage of operation during start-up, condensate produced by the condenser will flow into the bearings of the turbine. After more heat is applied to the boiler, the level of the liquid in the boiler will drop between the predetermined level but will remain above the operating level. Under this condition, vaporized working fluid is supplied to both the condenser and the turbine which begins to rotate slowly. After still more heat is applied to the boiler, the level of liquid therein will reach the operating level; and in this condition, vaporized working fluid is supplied only to the prime mover with the result that the turbine rotates at its operating speed and lubrication of the bearings is achieved using condensate of vaporized working fluid that has passed through the turbine. In other words, under steady operating conditions, none of the working fluid is bypassed to the condenser as in the case of U.S. Pat. No. 2,961,550.

According to the present invention, an automatic starting system is provided comprising connection control means responsive to the level of liquid in the boiler for effecting a connection between the condenser and the vapor side of the boiler and for preventing a connection between the prime mover and the vapor side of the boiler when the level of liquid in the boiler exceeds a predetermined level below the cold level. The connection control means effects a connection between the condenser and the vapor side of the boiler and between the prime mover and the vapor side of the boiler when the level of liquid in the boiler lies between the predetermined level and the operating level at which the power plant operates in a steady-state condition.

The connection control means includes a bypass conduit connecting the boiler to the condenser, the inlet of the bypass conduit being above the cold level of the liquid in the boiler. The inlet of the supply conduit connecting the boiler to the prime mover is below the cold level of the liquid in the boiler. A connection between the inlet of the supply conduit and the vapor side of the boiler is prevented as long as the level of the liquid in the boiler exceeds a predetermined intermediate level that lies between the cold and the operating levels. Thus, condensate is supplied to the bearings before the prime mover receives vaporized working fluid.

When the level of liquid in the boiler drops below the predetermined intermediate level, the connection of the boiler to the condenser is maintained via the bypass conduit, and, additionally, a connection is effected between the inlet of the supply conduit and vapor side of the boiler, thereby furnishing vaporized working fluid to the prime mover which begins to operate. Valve means associated with the bypass conduit effects a connection between the inlet of the bypass conduit and the vapor side of the boiler when the boiler exceeds the predetermined level. This valve means blocks the inlet of the bypass conduit when the level of the liquid in the boiler drops to the operating level.

BRIEF DESCRIPTION OF THE DRAWINGS

An embodiment of the invention is shown in the accompanying drawings, wherein.

BEST MODE FOR CARRYING OUT THE INVENTION

Figures 1, 2:
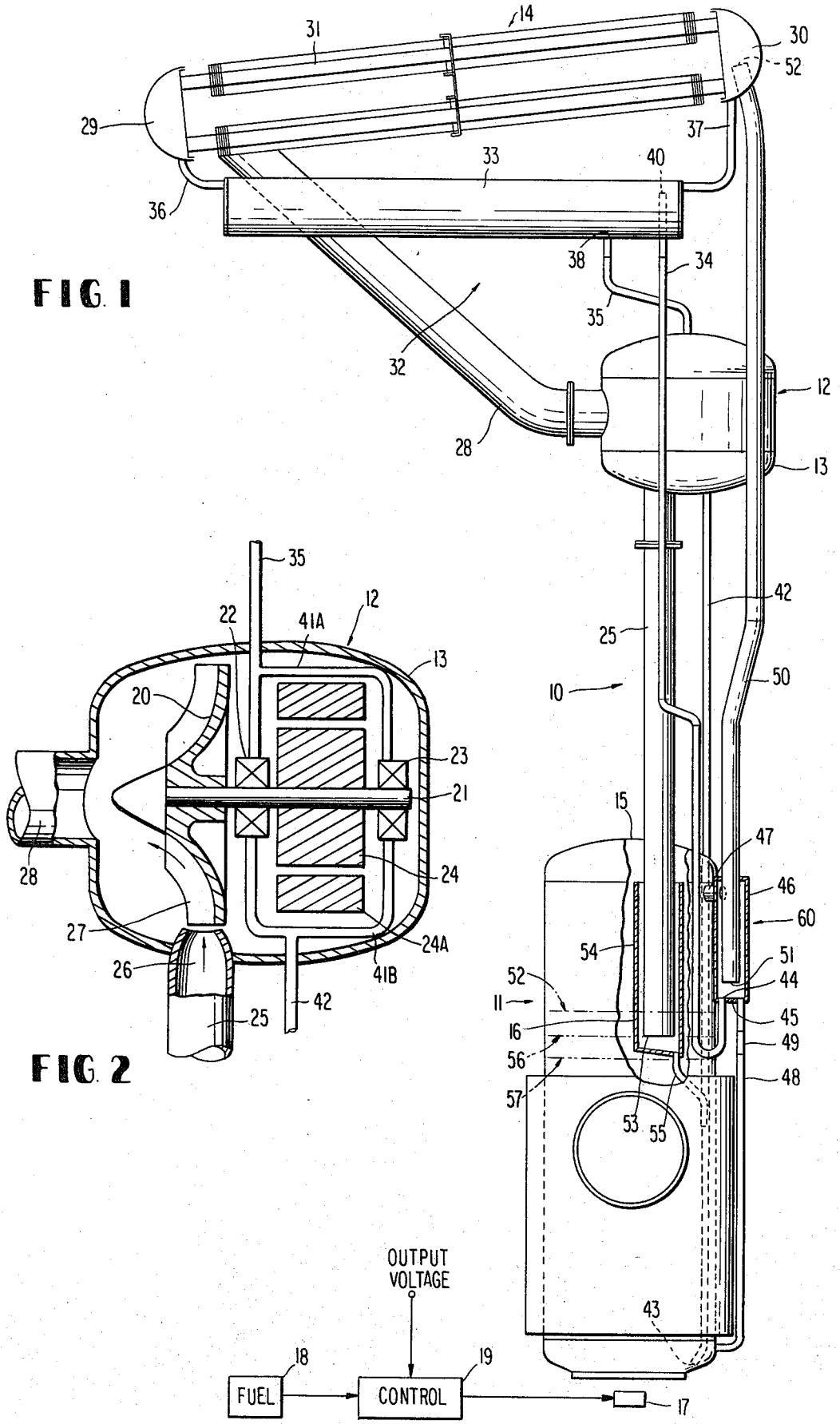
FIG. 1 is an elevation view of a power plant according to the present invention with parts broken away to facilitate illustrating the invention.
FIG. 2 is a sectional view of the prime mover shown in FIG. 1.

Referring now to FIG. 1, reference numeral 10 designates a closed, Rankine cycle power plant according to the present invention comprising boiler 11, prime mover 12 contained in cannister 13, and condenser 14. Boiler 11 is conventional in nature and comprises closed pressure vessel 15 containing organic working fluid 16 whose level is dependent on the amount of heat flux to the boiler. The space above the liquid level is filled with vaporized working fluid and is termed the "vapor side" of the boiler. That portion of the boiler below the surface of the liquid is termed the "liquid side" of the boiler.

Combustion gases produced by burner 17 at the bottom the boiler passes upwardly through heat exchange tubes (not shown) immersed in the liquid in the boiler and exit through a suitable vent. Burner 17 is provided with fuel indicated schematically by reference numeral 18 through control valve 19 operated by the level of the output voltage from the prime mover. When the voltage is less than the rated output voltage, control 19 admits fuel to the burner; and when the voltage is greater than the rated output, control 19 shuts off fuel to the burner.

Prime mover 12 comprises turbine wheel 20 (FIG. 2) fixed to shaft 21 which is rotatably mounted in a pair of hydrostatic bearings 22,23. Intermediate the bearings and mounted on shaft 21 is generator rotor 24. The stator windings 24A are associated with rotor 24 for the purposes of generating electricity when turbine wheel 20 rotates in response to vaporized working fluid furnished by the boiler via supply conduit 25 to nozzles 26 which direct the vaporized working fluid into engagement with a plurality of blades 27 on the turbine wheel. The turbine extracts work from the vaporized working fluid which exhausts from the turbine at essentially the condenser temperature and pressure. The exhaust vapor passes through exhaust conduit 28 into lower header 29 of condenser 14 which includes upper header 30 interconnected by a plurality of heat exchanger tubes 31 which are finned for the purpose of increasing the heat transfer characteristics of the condenser.

Associated with the condenser is condensate conduit system 32 which comprises liquid storage tank 33, primary liquid return conduit 34 and secondary liquid return conduit 35. Tank 33 is connected by respective pipes 36 and 37 to headers 29 and 30 of condenser 14.

Inlet 38 of secondary liquid return conduit 35 is connected to the bottom of tank 33 while the upper end of primary liquid return conduit 34 extends into the tank such that inlet 40 of conduit 34 is located at a higher elevation than inlet 38 of conduit 35. As a consequence of this arrangement, the presence of condensate at any level in tank 33 will result in the flow of condensate through conduit 35. On the other hand condensate will flow through conduit 34 only when the level of liquid in tank 33 reaches inlet 40 of conduit 34.

As shown in FIG. 2, conduit 35 is connected to hydrostatic bearings 22 and 23 by line 41A. The discharge from these bearings is collected by pipe 41B which is connected to pipe 42 which constitutes the bearing return conduit whose discharge end 43 is located near the bottom of boiler 11. The design of hydrostatic bearings 22 and 23 and the rotational speed of the turbine will determine the rate at which liquid condensate flows in conduit 35 and conduit 42. In general, the flow through conduit 34 under steady-state conditions will be 30 or 40 times as great as the flow through conduit 35. Thus, primary liquid return conduit 34 will carry most of the liquid in tank 33 returned to the boiler. Outlet 44 of conduit 34 is connected to bottom 45 of closed chamber 46 that itself is connected by conduit 47 to the vapor side of boiler 11. Bottom 45 of chamber 46 is also connected to the boiler by bleed line 48 which contains orifice 49 whose purpose is described below. Under steady-state operating conditions, condensate passing through conduit 34 fills chamber 46 to the level of conduit 47, the excess spilling through conduit 47 into the vapor side of the boiler for return to the liquid at the bottom of the boiler. The liquid head arising from the physical elevation of tank 33 relative to the boiler provides a pressure on the condensate at its interface with the boiler which is adequate to effect the return of condensate to the boiler without the use of a pump.

Chamber 46 is connected to header 30 of the condenser by a bypass conduit 50 whose lower inlet 51 is adjacent bottom 45 of chamber 46. The upper open end 52 of conduit 50 connects to upper header 30 of the condenser.

When power plant 10 is in its quiescent state (i.e., the boiler is cold) all of the liquid in the system is contained in the boiler. Consequently, liquid in the boiler will be at its highest level which is indicated by reference numeral 52. This is termed the "cold level" of the operating liquid in the boiler. Inlet end 53 of supply conduit 25 is below the cold level 52 while inlet 51 of bypass conduit 50 is above the cold level. The inlet end of supply conduit 25 is contained within cup-shaped sleeve 54 supported within the boiler and having a drain pipe 55 connected to the bottom of the sleeve. Thus, when the liquid is at its cold level in the boiler, the vapor side of the boiler is connected only to the condenser. Tank 33 is completely empty and the turbine wheel is stationary.

Figure 3:
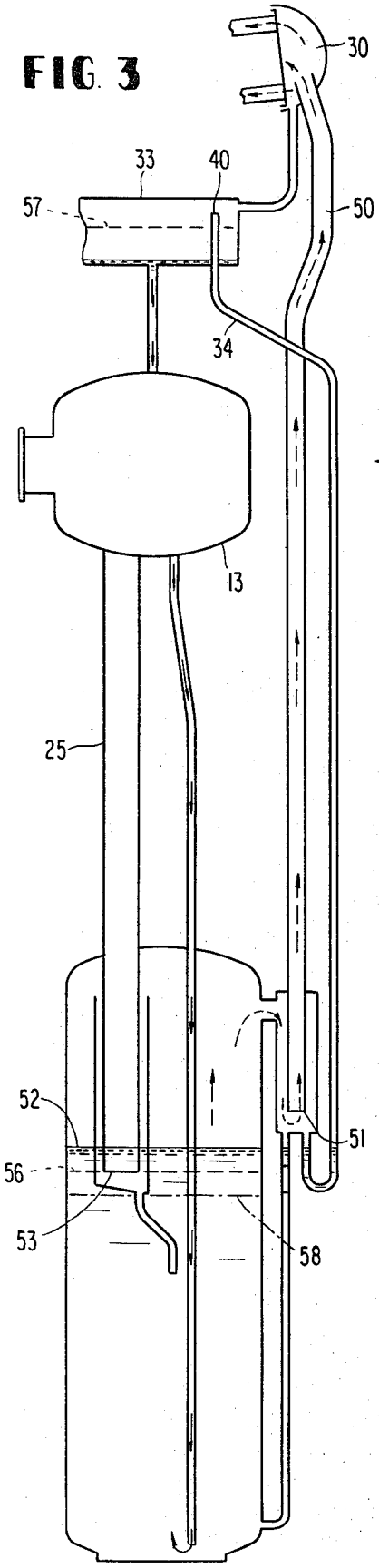
FIGS. 3–5 are schematic showings of the power plant of FIG. 1 for the purpose of illustrating the various states through which the power plant passes during a cold-start.

When fuel is supplied to burner 17 and heat is supplied to the boiler to cold start the power-plant, liquid working fluid in the boiler will vaporize pressurizing the vapor side of the boiler. Vaporized working fluid will be blocked from entering inlet 53 of supply 25 to the prime mover until the level of liquid in the boiler reaches an intermediate level identified by reference numeral 56 defined essentially by the level of inlet 53. During the time that the liquid drops from level 52 to level 56, the power plant will operate in what is termed an initial transient state following a cold-start wherein vaporized working fluid is supplied only to the condenser. That is to say, while inlet 53 is blocked, vaporized working fluid enters closed chamber 46 via conduit 47 and passes through inlet 51 of bypass conduit 50 before entering header 30 of condenser 14. The vapors in the condenser are condensed and the condensate enters tank 33 through pipes 36,37. Condensate produced during the initial transient state will flow into tank 33 but will not reach the level of inlet 40. Because inlet 38 is located in the bottom of tank 33, condensate will flow through conduit 35 into bearings 22,23 of the prime mover before inlet 53 is uncovered. Thus, liquid working fluid is supplied to the bearings before vaporized working fluid is supplied to the prime mover. This situation is illustrated in FIG. 3 wherein the broken-line arrows indicate the flow of vapor, while the solid-line arrows indicate the flow of condensate. When the level of liquid in the boiler 11 reaches the intermediate level 56, the level of condensate in tank 33 will still be somewhat below inlet 40 of conduit 34 as indicated schematically by reference numeral 57. That is to say, no condensate will flow in conduit 34 at the point of incipient vapor flow in conduit 25.

Figure 4:
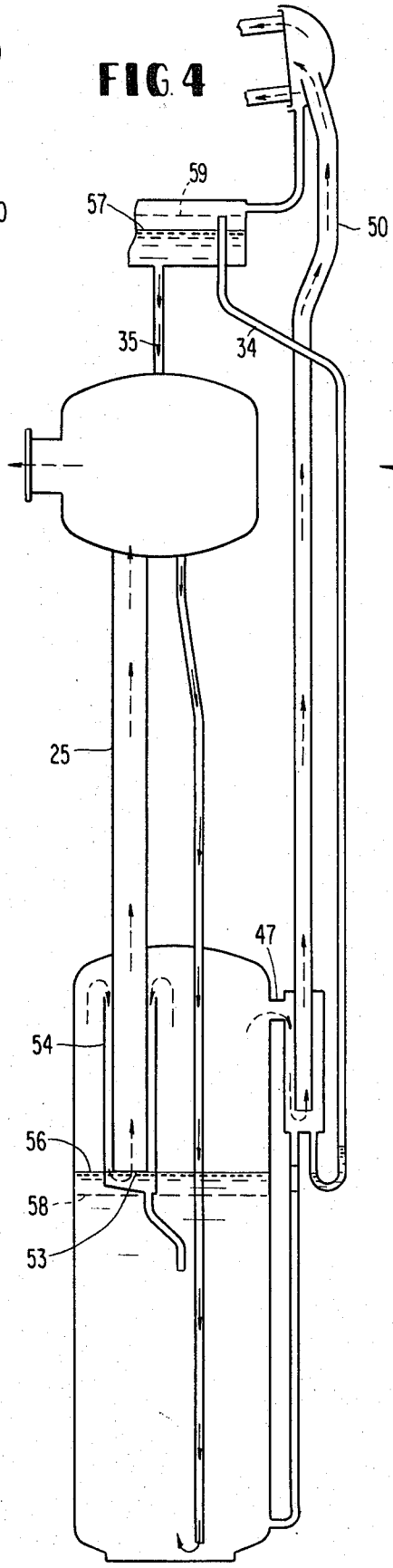

When the level in the boiler drops below intermediate level 56, inlet 53 will be above the liquid level with the result that vaporized working fluid will enter conduit 25 and pass through the turbine blades thereby initiating rotation of the turbine. This situation is illustrated in FIG. 4 which shows vaporized working fluid entering conduit 25 while vaporized working fluid continues to flow via conduit 50 into condenser 14. Cup-shaped sleeve 54 functions as a gas/liquid separator.

As additional heat is furnished to the boiler, the liquid level will drop from intermediate level 56 toward operating level 58. The volume of the boiler between the levels 52 and 58 (which is shown in hatched lines in FIG. 3) is substantially equal to the volume of tank 33 measured between the inlet 38 of conduit 35 and inlet 40 of conduit 34. As a consequence, the power plant will operate in what is termed a final transition state of start-up wherein vaporized working fluid is furnished by the boiler to both the prime mover and the condenser.

Figure 5:
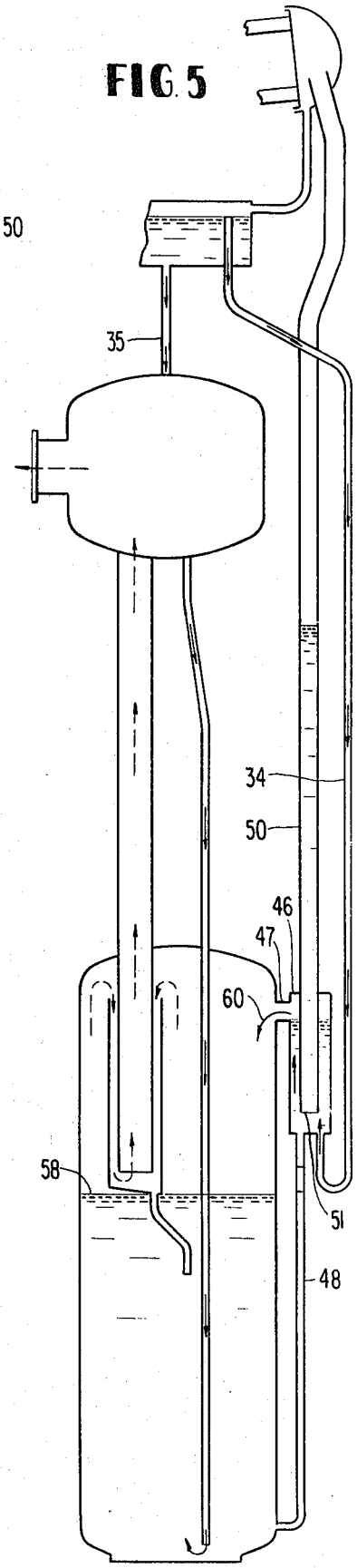

When the liquid level in the boiler reaches operating level 58, the level in tank 33 will have risen from level 57 to level 59 (FIG. 4) which is defined by the elevation of inlet 40 of conduit 34. When this occurs, condensate will begin to flow through primary liquid return conduit 34 as indicated in FIG. 5 thereby causing chamber 46 to begin to fill with condensate. As soon as the condensate level in chamber 46 reaches inlet 51 of bypass conduit 50, the condensate will block the vapor side of the boiler from the condenser. Because of the relatively small size of the closed chamber, condensate will quickly fill the chamber to the level of conduit 47 and then flow as indicated by arrow 60 back into the boiler. Chamber 46, in cooperation with bypass conduit 50 and the primary liquid return conduit 34, constitutes valve means 60 that blocks the inlet of the bypass conduit when the level of liquid in the boiler reaches the operating level. Because the vapor pressure in the boiler greatly exceeds the vapor pressure in the condenser, the liquid condensate will rise in bypass conduit 50 to a level just below the cannister 13 as indicated in FIG. 5. The power plant will continue to operate in its steady-state as long as sufficient heat is furnished to the boiler for maintaining the liquid therein at operating level 58.

The present invention controls the application of vaporized working fluid to the prime mover and to the condenser in accordance with the level of liquid in the boiler by reason of connection control means that comprises condensate conduit system 32, the relative elevations of inlets 51, 53 with respect to the cold level of liquid in the boiler, and the presence of valve means 60.

When the liquid in the boiler lies between the cold level 52 and the intermediate level 56, vaporized working fluid is supplied only to the condenser. As a consequence, liquid working fluid is supplied to the bearings before vaporized working fluid is supplied to the prime mover. Thus, the bearings are furnished with lubrication before the turbine moves. When the level of liquid in the boiler is between predetermined level 56 and operating level 58, vaporized working fluid is supplied to both the condenser and the prime mover as shown in FIG. 4. In this case, the turbine rotates and the bearings are supplied with working fluid. When sufficient heat is supplied to the boiler for lowering the level of the liquid therein to the operating level as shown in FIG. 5, vaporized working fluid is supplied only to the prime mover and is cut off from the condenser. Consequently, the present invention can be described as supplying vaporized working fluid only to the condenser when the power plant is cold-started, and supplying vaporized working fluid only to the prime mover when the power plant is in steady-state operation.

When power plant operation is to be terminated, control 19 is operated to deprive burner 17 of fuel with the result that the boiler cools and the level of liquid in the boiler rises as the condensate drains into the boiler. First, the level of condensate in tank 33 will drop below inlet 40 of conduit 34 with the result that no additional condensate will be furnished to chamber 46 which will drain through bleed-line 49 into the boiler. The reduced pressure in the boiler permits the condensate contained in bypass conduit 50 to drain into chamber 46. Orifice 49 in the bleed line controls the rate at which chamber 46 is drained. By suitable design, the liquid contained in the bypass conduit quickly drains (in say ten minutes) following burner shut-down. The liquid in tank 33 will remain substantially constant during this time because of the bearings form a constriction in conduit 35 preventing rapid draining of tank 33. Thus, shortly after burner shut-down, and before the level of liquid in the boiler has returned to intermediate level 56, inlet 51 of bypass 50 will be again connected to the vapor side of the boiler. Tank 33 will drain through the bearings of the prime mover over a relatively long period of time (say 4 days). During this period, a warm start-up of the power plant can be effected by the re-application of heat to the boiler. Such a start-up will find the inlet 53 of the supply conduit and the inlet 51 of the bypass conduit open to the vapor side of the boiler and the bearings already supplied with liquid working fluid. The turbine is thus in condition for, and will immediately begin, rotation eliminating any programmed start-up procedure other than firing the boiler. Therefore a warm start-up can occur any time within about two days following shut-down with the assurance that the bearings will be lubricated when turbine rotation begins and full scale power production can be reached quickly.

After about 2 days following shut-down, the level of liquid in the boiler will reach the intermediate level and thereby block or disconnect the vapor side of the boiler from the prime mover. An attempt to start the power plant when this occurs will result in the application of vaporized working fluid to the condenser and the filling of tank 33 before the turbine begins to move.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

What is claimed is:

1. In a closed, Rankine cycle power plant of the type having a boiler responsive to the application of heat for vaporizing a liquid working fluid that has a cold level when the power plant is not operating and an operating level below the cold level when the power plant is in steady-state operation, a prime mover responsive to working fluid vaporized by the boiler for producing work, a condenser for condensing vaporized working fluid exhausted by the prime mover and condenser conduit connection means for returning part of the condensate to the boiler through the bearings of the prime mover and the balance of the condensate directly to the boiler, the improvement comprising:

means for supplying vaporized working fluid only to the condenser when the power plant is cold-started and supplying vaporized working fluid only to the prime mover when the power plant is in steady-state operation.

2. The improvement of claim 1 including controlling the application of vaporized working fluid to the prime mover and to the condenser in accordance with the level of liquid in the boiler.

3. The improvement of claim 2 wherein vaporized working fluid is supplied only to the condenser when the boiler is heated and the liquid therein is at the cold level whereby liquid working fluid is supplied to the bearings before vaporized working fluid is supplied to the prime mover.

4. The invention of claim 3 wherein vaporized working fluid is supplied only to the condenser when the boiler is heated and the level of the liquid therein exceeds a predetermined level that is intermediate the cold level and the operating level.

5. The improvement of claim 4 wherein vaporized working fluid is supplied to both the condenser and the prime mover when the boiler is heated and the liquid therein is between the predetermined level and the operating level.

6. The improvement of claim 5 wherein vaporized working fluid is supplied only to the prime mover when the boiler is heated and the level of the liquid therein is at the operating level.

7. An automatic start-up system for power plant of the type having a boiler containing liquid working fluid having a cold level when the power plant is not operating and an operating level below the cold level when the power plant is in steady-state operation, the working fluid being vaporized in response to heating of the boiler, a prime mover connected to the boiler by a supply conduit for producing work in response to the flow of vaporized working fluid in the supply conduit, a condenser connected to the prime mover by an exhaust conduit for condensing vaporized working fluid to a liquid in response to the flow of vaporized working fluid in the exhaust conduit, and a condensate conduit system connected to the condenser for returning a portion of the condensate to boiler through the bearings of the prime mover, and the balance directly to the boiler, said system comprising:

connection control means responsive to the level of liquid in the boiler for effecting a connection between the condenser and the vapor side of the boiler and for preventing a connection between the prime mover and the vapor side of the boiler when the level of liquid in the boiler exceeds a predetermined level.

8. An automatic start-up system for a power plant according to claim 7 wherein the connection control means effects a connection between the condenser and the vapor side of the boiler and between the prime mover and the vapor side of the boiler when the level of liquid in the boiler lies between the predetermined level and the operating level at which the power plant operates in a steady-state condition.

9. An automatic start-up system for a power plant according to claim 8 wherein the connection control means comprises:

(a) a bypass conduit connecting the boiler to the condenser, the inlet of the bypass conduit being above the cold level of the liquid in the boiler; and (b) the inlet of the supply conduit being below the cold level of the liquid in the boiler.

10. An automatic start-up system for a power plant according to claim 9 wherein the condenser includes a pair of headers interconnected by a plurality of inclined heat exchanger tubes such that one header is elevated above the other, the exit of the bypass conduit being connected to the upper of the two headers and the exit of the exhuaust conduit being connected to lower of the two headers.

11. An automatic start-up system for a power plant according to claim 9 including means associated with the supply conduit for preventing a connection between the inlet of the supply conduit and the vapor side of the boiler while the level of the liquid in the boiler exceeds a predetermined intermediate level between the cold and operating levels.

12. An automatic start-up system for a power plant according to claim 11 wherein the means associated with the supply conduit includes a cup-shaped sleeve within which the inlet end of the supply conduit extends, and a tube connecting the interior of the sleeve to the liquid side of the boiler, the top of the sleeve being open to the vapor side of the boiler.

13. An automatic start-up system for a power plant according to claim 11 wherein the means associated with the supply conduit effects a connection between the inlet of the supply conduit and the vapor side of the boiler when the level of the liquid in the boiler is less than the predetermined intermediate level.

14. An automatic start-up system for a power plant according to claim 13 including valve means associated with the bypass conduit for effecting a connection between the inlet of the bypass conduit and the vapor side of the boiler when the liquid in the boiler exceeds the predetermined intermediate level.

15. An automatic start-up system for a power plant according to claim 14 wherein the valve means blocks the inlet of the bypass conduit when the level of the liquid in the boiler is less the predetermined intermediate level.

16. An automatic start-up system for a power plant according to claim 15 wherein the inlet of the bypass conduit is blocked by condensate directly returned to the boiler from the condenser.

17. An automatic start-up system for a power plant according to claim 16 wherein the condensate conduit system includes a liquid storage tank located between the condenser and the prime mover for receiving condensate produced by the condenser, a primary liquid return conduit connecting the liquid storage tank to the valve means, a secondary liquid return conduit connecting the liquid storage tank to the bearings of the prime mover and a bearing return conduit connecting the outflow of the bearings with the boiler.

18. An automatic start-up system for a power plant according to claim 17 wherein the valve means includes a closed chamber into which the bypass conduit passes such that the inlet is adjacent the bottom of the chamber and the outlet of the primary liquid return conduit is connected to the bottom of the chamber, the chamber having a connection near the top to the vapor side of the boiler.

19. An automatic start-up system for a power plant according to claim 18 including a bleed line connecting the bottom of the chamber with the liquid side of the boiler, the bleed line having a restriction for limiting discharge of condensate from the chamber when heating of the boiler is terminated.

20. An automatic start-up system for a power plant according to claim 19 wherein the inlet of the primary liquid return conduit is elevated with respect to the inlet of the secondary liquid return conduit.

21. An automatic start-up system for a power plant according to claim 20 wherein the volume of the liquid storage between the inlets of the primary and secondary liquid return conduit is substantially equal to the volume of the boiler between the cold level and said predetermined level.

* * * * *

UNITED STATES PATENT AND TRADEMARK OFFICE

CERTIFICATE OF CORRECTION

PATENT NO. : 4,386,499

DATED : June 7, 1983

INVENTOR(S) : Avi RAVIV and Abraham DAHAN

It is certified that error appears in the above-identified patent and that said Letters Patent is hereby corrected as shown below:

Column 1, line 3, "used" should read ---uses---.

Column 1, line 1, after "relates" insert ---to---.

Column 1, line 44 after "result" insert ---in---.

Column 4, line 32, "passes" should read ---pass---.

Column 10, line 8, after "less" insert ---than---.

Column 10, lines 46-47, change "predetermined" to ---operating---.

Signed and Sealed this

Thirty-first Day of March, 1987

*Attest:*

DONALD J. QUIGG

*Attesting Officer*

*Commissioner of Patents and Trademarks*